US005176385A

United States Patent [19]

Tagliaferro

[11] Patent Number: 5,176,385

[45] Date of Patent: Jan. 5, 1993

[54] TROUT COUNTRY COMPETITIVE FISHING GAME

[76] Inventor: Michael G. Tagliaferro, 92 Brighton Ave., Glen Ridge, N.J. 07028

[21] Appl. No.: 754,751

[22] Filed: Sep. 4, 1991

[51] Int. Cl.[5] ..... A63F 3/00

[52] U.S. Cl. ..... 273/244

[58] Field of Search ..... 273/236, 242, 243, 244, 273/259

[56] References Cited

U.S. PATENT DOCUMENTS

| | | | |
|---|---|---|---|
| 3,888,489 | 6/1975 | Kane | 273/244 |
| 3,921,981 | 11/1975 | Ashburn | 273/244 |
| 4,003,578 | 1/1977 | Jones | 273/244 |

FOREIGN PATENT DOCUMENTS

| | | | |
|---|---|---|---|
| 641446 | 6/1962 | Italy | 273/244 |
| 1405897 | 9/1975 | United Kingdom | 273/244 |
| 2123304 | 2/1984 | United Kingdom | 273/244 |

*Primary Examiner*—William H. Grieb
*Assistant Examiner*—William E. Stoll
*Attorney, Agent, or Firm*—John P. Halvonik

[57] ABSTRACT

The invention relates to a simulated game of trout fishing played on a board having spaces to represent trout pools, obstructions and reflection pools. The object of the game is to promote sportsmanship, conservation, and enviromentalism and to win the game by garnering points for sportsmanship as well as catching trout.

1 Claim, 6 Drawing Sheets

TROUT COUNTRY COMPETITIVE FISHING GAME

BACKGROUND OF THE INVENTION

1. Field of the Invention

The invention relates to a competitive game of fishing for trout in which 2-6 players engage in fishing for the most trout and garnering sportsman points.

2. Description of the Prior Art

While there are fishing games that are known, none of them teach the use of different fly fishing methods.

SUMMARY OF THE INVENTION

The invention relates to a game of fly fishing in which designated players (anglers) catch trout by employing one of the three fly fishing methods (wet, dry and nymph), the Light Cahill being the only insect artificial whereby the player must employ all three fly methods, the Light Cahill dry, wet and nymph methods. Tokens represent the various players and play involves moving the tokens around a game board along spaces that indicate trout pools (each with a specific fly fishing method indicated), obstruction spaces (forcing the player to turn around) and reflection pools (which require a player to draw a card from the deck of reflection pool cards).

The players fill their creels with the trout they catch by the various fly fishing methods. There are four different creels to represent the three fly fishing methods. Points are scored for the type of method employed (based on the difficulty level) as well as the number of fish caught. Players may also score sportsman points by releasing trout they have caught, by being awarded or penalized sportsmen points from cards drawn when landing on the reflecting pool spaces and are penalized at the end of the game for trout in creels that are not filled. Game ends as pools are fished out or when the end of the game card is drawn.

An object of the game is to promote the tradition of fly fishing through the history of the more popular flies and their origins, each of which are briefly described on the back of the creel cards.

Another objective is to promote awareness of environmental concerns regarding the aquatic environment by awarding points to players who release trout and perform other conservation activities.

Yet another objective is to promote sportsmanship by awarding and penalizing players for such activities as putting out fires, walking in stream beds, etc.

Still another objective is to promote strategy by encouraging players to catch trout by various methods and to release trout to avoid being penalized at the end of the game.

Other objectives will become apparent once the invention is shown and described.

DRAWINGS

DESCRIPTION OF THE EMBODIMENT

The game begins as the players are assigned tokens to represent their movements along the spaces which circle the board. A riverkeeper (which may be one of the players) issues the creel arrangement chart (to keep track of the trout caught) and the angler's log to each player. The Anglers Log, keeps a record of the achievements of each player measured numerically as "Total Game Points".

Then the riverkeeper shuffles the reflection pool cards and makes sure that the "end of the game" card is placed at the bottom of the pile of reflection pool cards.

The players roll dice (or other random number generator can be used) to determine their movements along the board. The spaces of the board form a pathway and there are three different type of spaces: reflection pools, obstruction spaces and fly fishing pools. The players move their tokens the number shown on the dice and land on the spaces. Upon landing on an obstruction space, the player must reverse direction around the path.

When landing on a trout pool the player "catches" the fish located there by employing the fly fishing method indicated over the pool. For example, landing on the "Royal Coachman Pool" (a type of dry fly) which indicates that the trout was caught by employing the dry fly fishing method. The other pools indicate wet and nymph fly fishing methods as the method employed.

Figure 1:
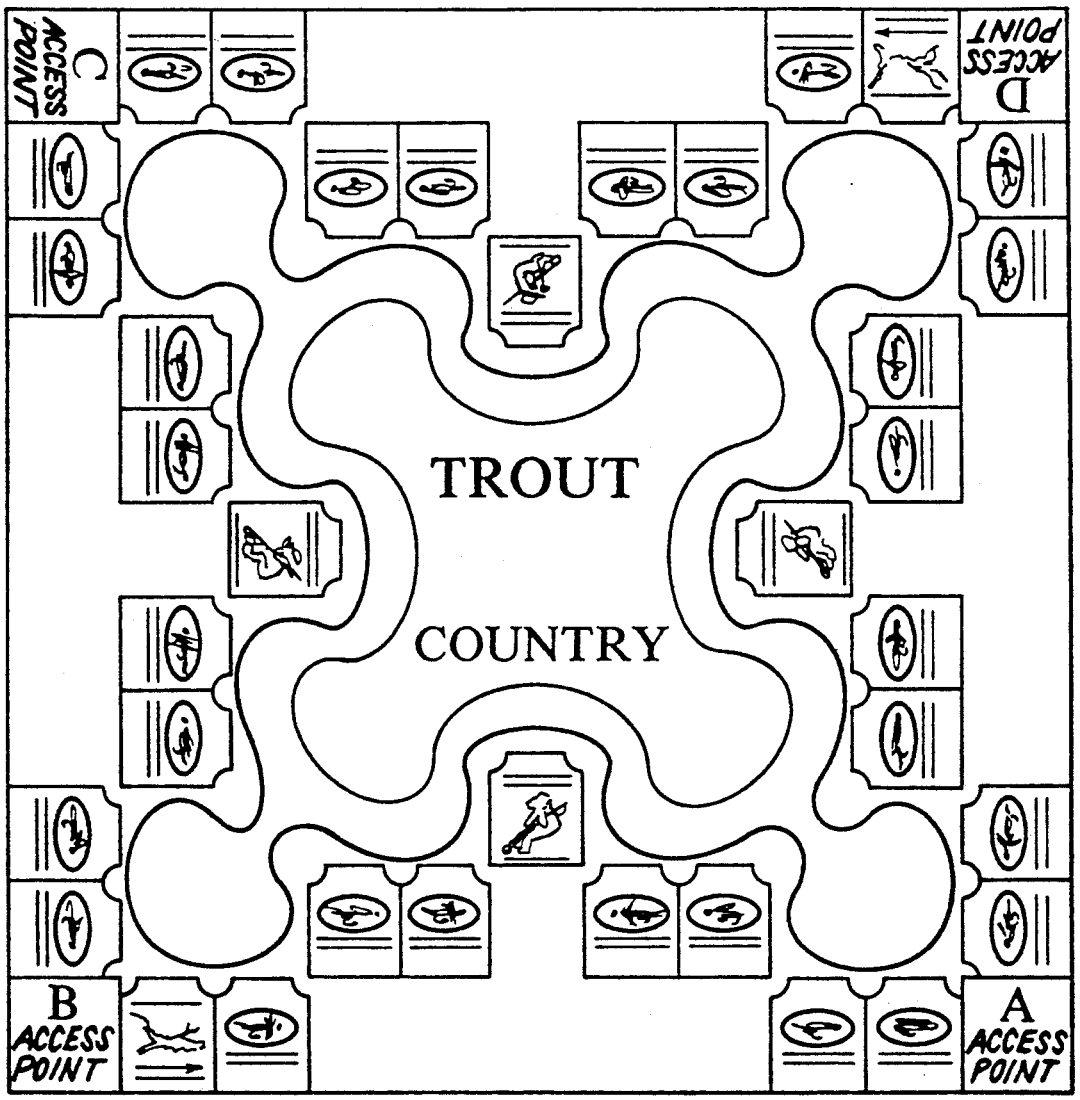
FIG. 1 shows game board.
Figure 2:
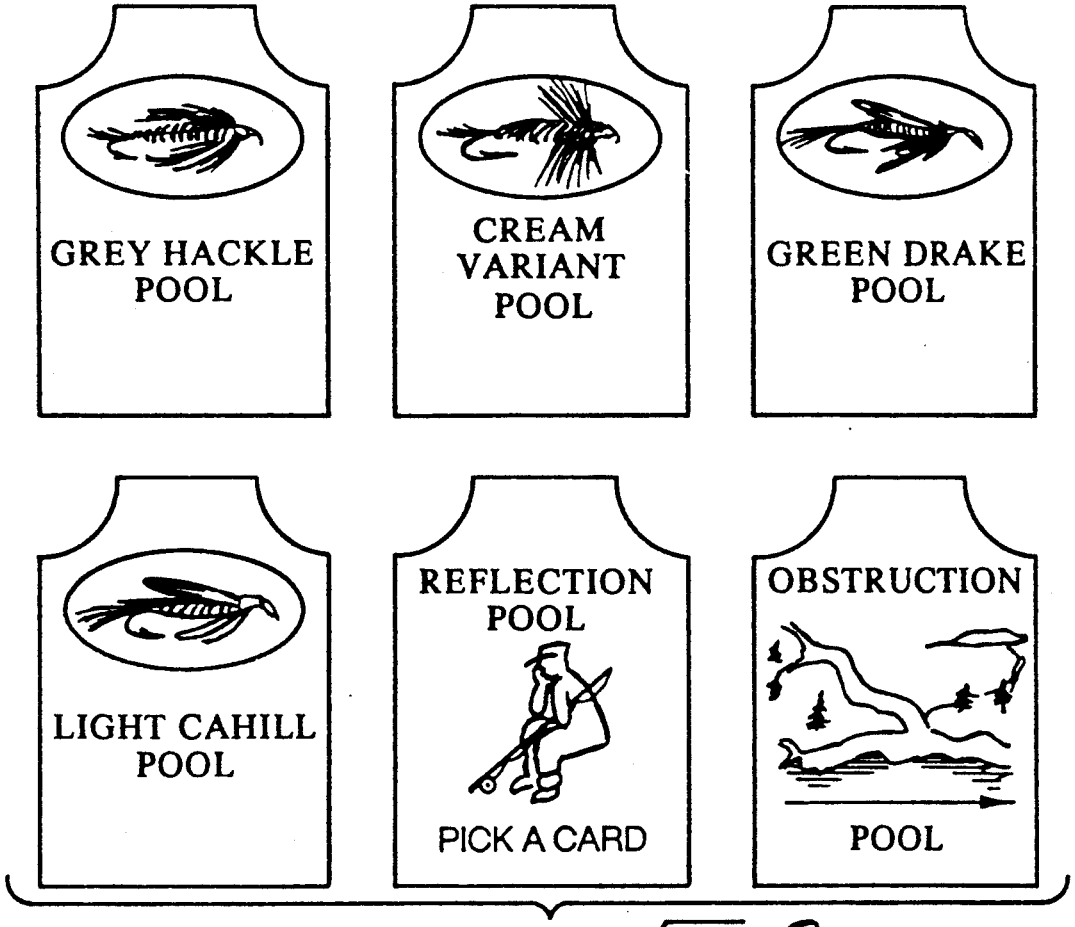
FIG. 2 shows different spaces on the board.
Figure 4:
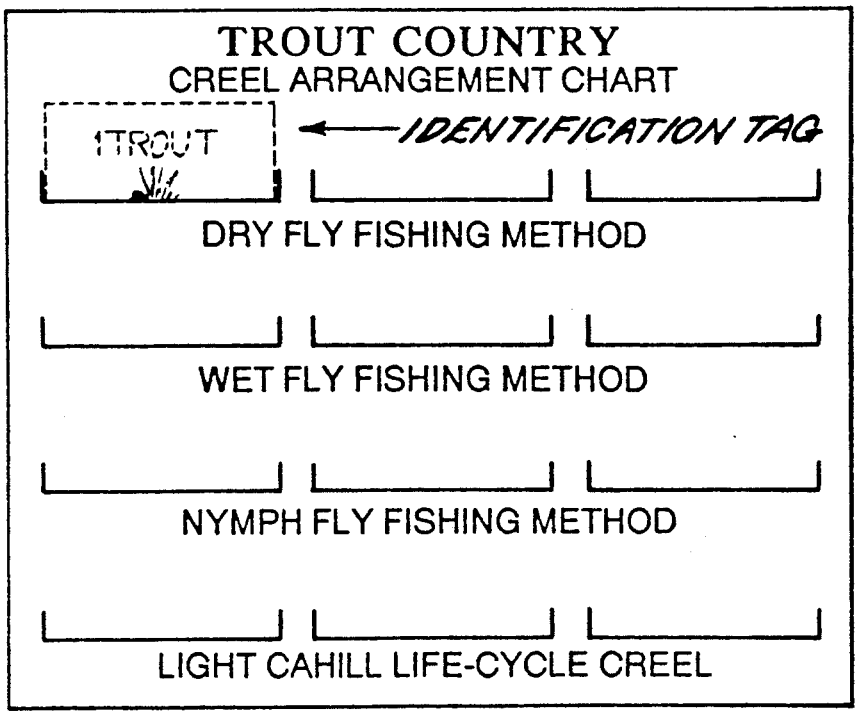
FIG. 4 shows creel arrangement chart.

When the player decides to "Creel" (keep) the trout he has caught he is issued the appropriate identification tag. Each identification tag represents one "creeled" trout caught by either the dry, wet, or nymph fly fishing method. The Identification Tags are color-coordinated to reflect the dry, wet and nymph fly fishing methods. The player places the identification tag into the proper slot located on the Creel Arrangement Chart illustrated in FIG. 4. Once the player has completed a Purist Creel he returns his Tags and is issued a Creel Card (See Purist Creels).

Creel Arrangement Chart

The "real" action and game strategy is developed through the player's management of his Creel Arrangement Chart. Of the three Purist Creels available, the player may only "work" two at a time. The Light Cahill Life-Cycle Creel may be worked with no restrictions.

Each of the four rows (of 3 slots each) represents trout caught by either the dry, wet or nymph fishing methods and (the last row) by the Light Cahill wet, dry and nymph combination. The top 3 rows of slots form the dry, wet and nymph purist creels, the last row represents the light cahill life cycle creel.

Creel Cards

Figure 3:
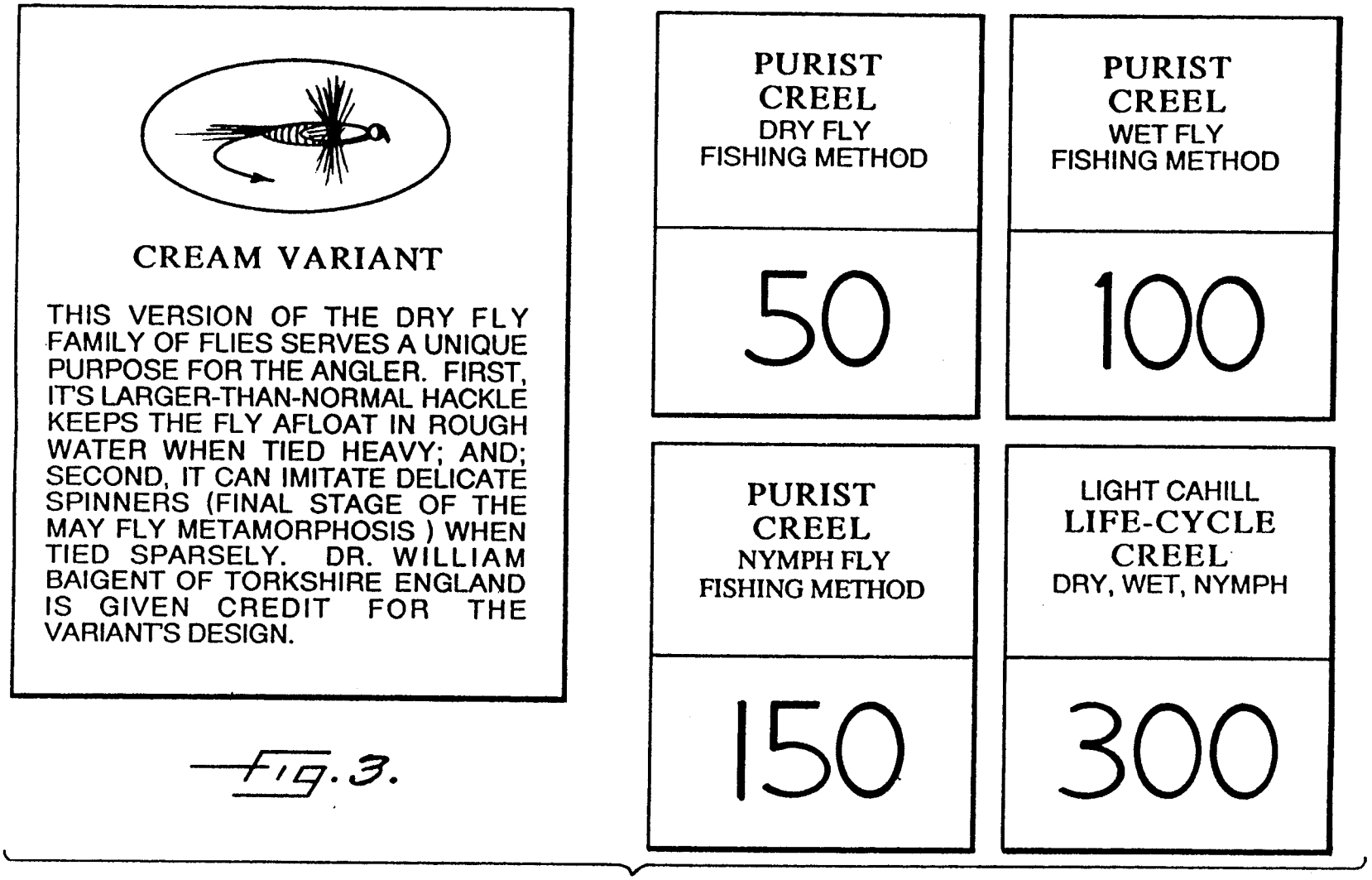
FIG. 3 shows a front view and several back views of creel cards.
Figure 5:
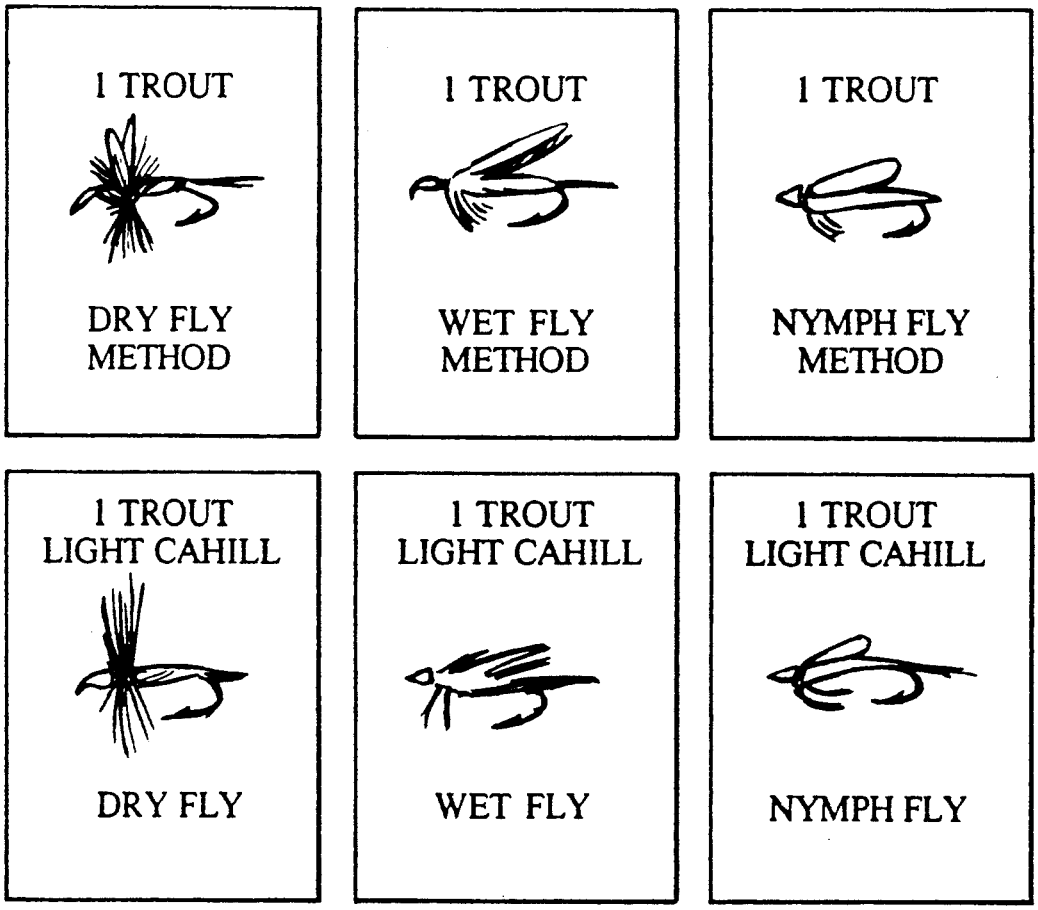
FIG. 5 shows identification tags.
Figure 6:
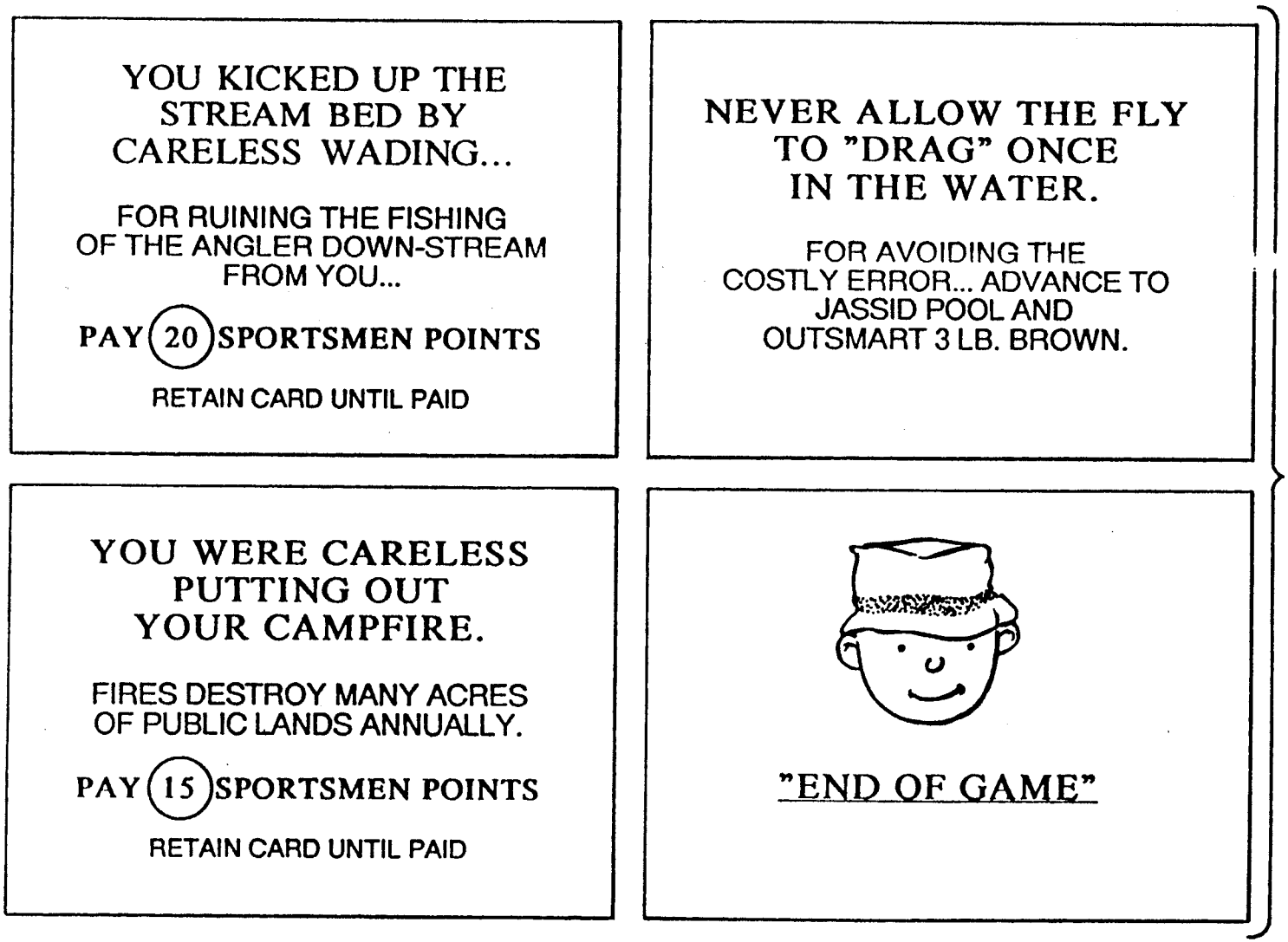
FIG. 6 shows reflection pool cards.
Figure 7:
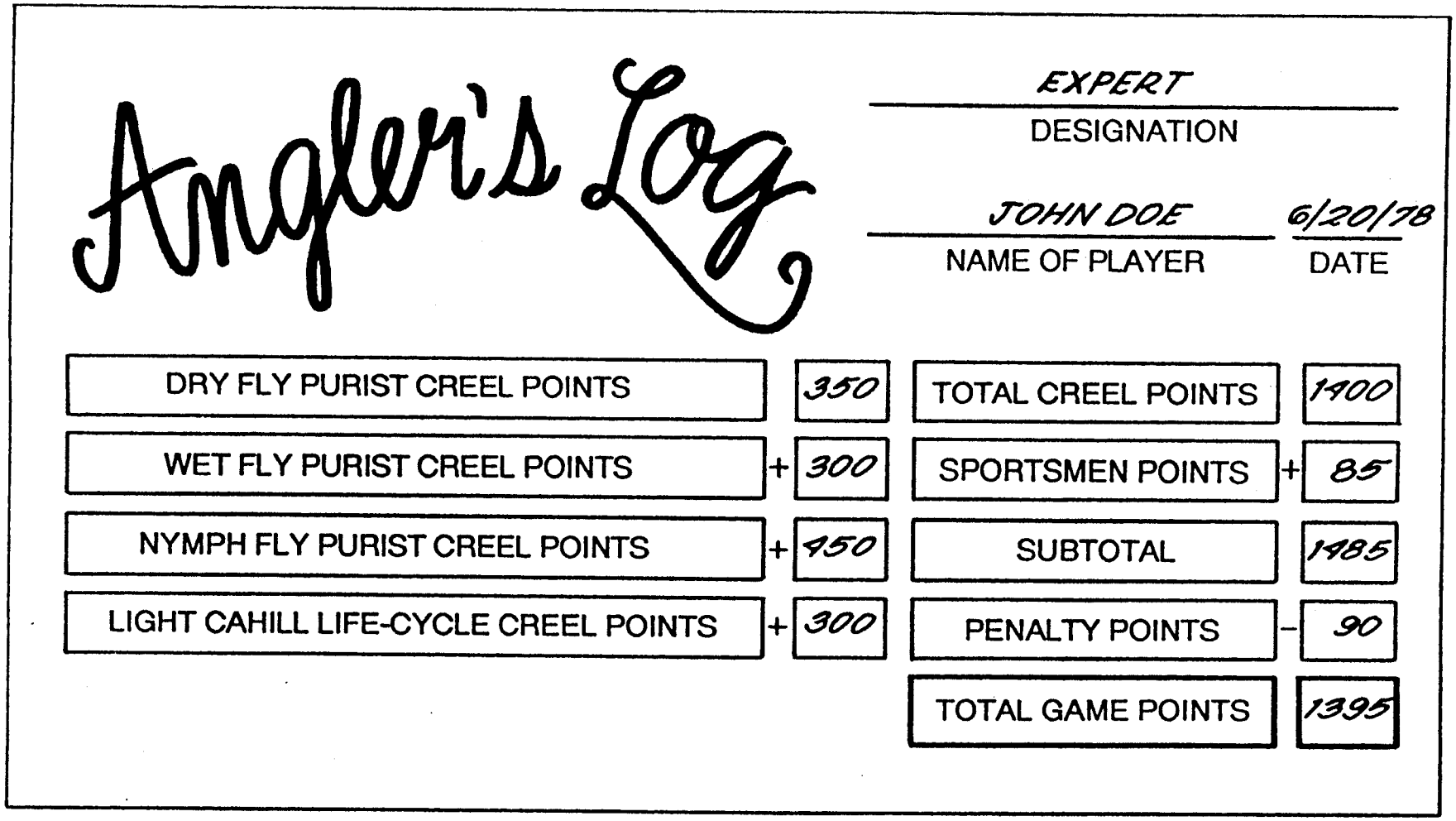
FIG. 7 shows angler's log.

FIG. 3 illustrates the Purist Creel Cards and their corresponding values (in Creel Points). A players is issued a Purist Creel card upon completion of any of the Purist Creels in his creel arrangment chart. A completed Purist Creel consists of 4 trout, each caught by employing the same fishing method. To complete the Life-Cycle Creel three fish are required, each caught by the Light Cahill dry, wet and nymph flies.

In effect, the player will have 3 identification tags (from the trout he has previously caught) and upon catching the fourth trout employing the same method he will then be issued a Purist Creel Card. Once a Creel is completed, the identification tags are returned to the Riverkeeper and, in return, the player receives the corresponding Creel Card and proceeds to continue or change his game strategy.

The creel points on the face of the Purist Creel and Life-Cycle cards reflect the difficulty or ease of the fly fishing method employed; hence, trout caught by the DRY fly fishing method (the most common of the pools on the board) has the least point value while the Light Cahill Life-Cycle Creel has the highest point value, since these pools number the fewest on the playing board.

On the back of each of the 3 types of Purist Creel Cards and the Light Cahill Life-Cycle Creel Cards there is a different artificial fly illustrated. There is a total of 30 creel cards. There is also a brief history of the artificial fly's origin and its subsequent development down through the ages to the present. The earliest of these is the "Hackle" fly which was first described in the 4th century A.D.

"Fished-Out" Pools

A trout pool is considered "fished out" when the Creel cards of a particular fly fishing method have all been distributed to the players; i.e. if the Riverkeeper has run out of the Dry Fly Purist Creel cards, then all pools where the dry fly method is employed becomes "fished-out". A player landing on a "fished-out" pool allows him one extra turn of the dice, only once each time it is his turn. If all the trout pools become "fished-out", even if before the "End of Game" card is pulled, the game is over.

"Releasing" Trout (Game Strategy)

A player may wish to "release" (return to the water safely) his trout in order to receive Sportsman Points. Each player is only allowed to work two of the three Purist Creels at any one time. Thus, the player must release back into the water all trout which would have been part of the third, non-working, Purist Creel. For every fish released by the player he is given the appropriate amount of Sportsman Points.

There will be times when he must release his trout because of a penalty because of Reflection Pool cards he has drawn. A player in possession of a penalty card must release all trout until he satisfies, in full, the requirements that will rid him of the penalty(s). Note: A player always receives Sportsman Points for releasing trout, no matter what the circumstances.

Sportsman Points

Aside from collecting Sportsman Points for releasing trout, the player could earn them by way of the Reflection Pool cards. If the card he picks is not a "penalty" card his reward might be because of his: 1) skill as an angler; 2) concern for the environment, 3) support of conservation organizations, and 4) promotion of the concept of Sportsmanship.

Reflection Pools

Upon landing on one of these, the player picks a card from the deck of reflection pool cards and proceeds as directed. If it is a "penalty" card he retains the card until the penalty is paid—see "Releasing" Trout (Penalty).

There are four types of 4 Reflection Pool cards: those having to do with Sportsmanship, those having to do with Skill, those dealing with our attitude toward the environment and conservation, and the "game over card" which ends the game suddenly when it is turned up.

End of Game: Game Points

Once the game is over the player adds up his Creel Points and Sportsman Points and records them in his Angler's Log. If he has in his possession an incomplete creel, he must pay a fine for each fish within the incomplete creel. The amount of the fine depends upon the method employed to catch the fish; hence, an incomplete creel holding one trout where the dry fly method was employed, calls for a fine of 10 Game Points; wet fly method, 20 Game Points; and nymph method, 30 Game Points. These are added up then subtracted from the combined total of Creel and Sportsman Points (now referred to as Game Points). The player having the highest Game Points is declared "Supreme Master" of Trout Country; the second highest "Master"; third highest, "Expert"; and the last, "Tyro".

These classifications might be for playing one game with a group of players. Perhaps, if players can agree beforehand, a series, say of 5, 10 or 20 games could be played and the player with the highest total of Game Points over the agreed upon extended period of time would be declared the Supreme Master of Trout Country.

I claim:

1. A method of playing a simulated trout fishing contest for 2–6 players based upon movement around a simulated trout stream comprising: designating a token to represent each of said players, placing said tokens upon a game board, said game board having spaces designated as trout pools, each of said pools designated by a specific type of fly fishing method, said methods comprising: dry fly, wet fly, nymph fly and light cahill methods, said trout pool spaces of varying number on the board to reflect the relative difficulty of those fly fishing methods, said board also having spaces designated as reflection pool and obstruction pool spaces said spaces arranged alongside one another continuously on a board to represent a pathway consisting of said spaces, play consisting of moving said tokens by each player in turn by moving said tokens along said path a number of spaces corresponding to randomly generated numbers, each of said players catching simulated trout upon landing upon said trout pool by the fly fishing method indicated on said pool and drawing cards from a deck of reflection pool cards upon landing upon said reflection pool spaces, and said players reversing direction upon landing upon said obstruction pool spaces, said reflection pool cards having instructions awarding or penalizing players game points according to said players' attitude toward environmental and sportsmanship concerns, whereby said players record said trout caught from said pools in creels having value according to the fishing method employed, said players being allowed to fill only three of the four creels at any one time, and said players receiving sportsman points for releasing fish that have been caught, the object of the game being to garner points based upon completely filling each of said creels with trout and being awarded a score based upon the level of difficulty of catching trout by means of said fly fishing method and being added said sportsmanship points that have been awarded and subtracting sportsman points that have been penalized, when all of said trout have been fished out from a particular fly fishing pool that pool is no longer available and no more trout are awarded when landing upon those pools, the game ends when either all fly fishing pools are fished out or the end game card is drawn from the reflecting pool deck, which ever comes first, the players tally their scores and that player with the most points is declared the winner.

* * * * *